United States Patent [19]

Thomas

[11] Patent Number: 4,826,136

[45] **Date of Patent: * May 2, 1989**

[54] LUMBER TURNING TOOL WITH LEVERAGE ENHANCING CLAW SURFACES

[76] Inventor: Philip G. Thomas, 1257 Siskiyo Blvd., Ashland, Oreg. 97520

[ * ] Notice: The portion of the term of this patent subsequent to Aug. 9, 2005 has been disclaimed.

[21] Appl. No.: 147,507

[22] Filed: Jan. 25, 1988

Related U.S. Application Data

[63] Continuation-in-part of Ser. No. 2,748, Jan. 12, 1987, Pat. No. 4,762,303.

[51] Int. Cl.[4] ..... B25C 11/00

[52] U.S. Cl. ..... 254/25; 254/131

[58] Field of Search ..... 254/18, 21, 25, 120, 254/131, 131.5, 28

[56] References Cited

U.S. PATENT DOCUMENTS

| | | | |
|---|---|---|---|
| 758,422 | 4/1904 | Harmon | 254/131 |
| 1,890,273 | 12/1932 | Wells | 254/131 |
| 2,181,849 | 11/1939 | Meltzer | 254/28 |
| 2,896,910 | 7/1959 | Cooper et al. | 254/131 |
| 4,625,945 | 12/1986 | Hearn et al. | 254/25 |

*Primary Examiner*—Frederick R. Schmidt
*Assistant Examiner*—Judy J. Hartman
*Attorney, Agent, or Firm*—William W. Haefliger

[57] ABSTRACT

In a lever type tool, the combination comprising:

(a) an elongated handle, and (b) a head having two opposed and spaced apart claws projecting in generally the same direction at opposite sides of a space to closely receive a portion of a rectangular cross section of a lumber member, (c) one of the claws at one side of the space being substantially shorter in length than the other of the claws at the opposite side of the space, (d) the claws having first inner surfaces, (e) the one claw having an outward convex outer surface to engage a work surface, and a second inner surface offset relative to the first inner surface thereof and toward the convex outer surface, the tines of the one claw having opposed faces that merge together at a locus that intersects the second inner face.

14 Claims, 3 Drawing Sheets

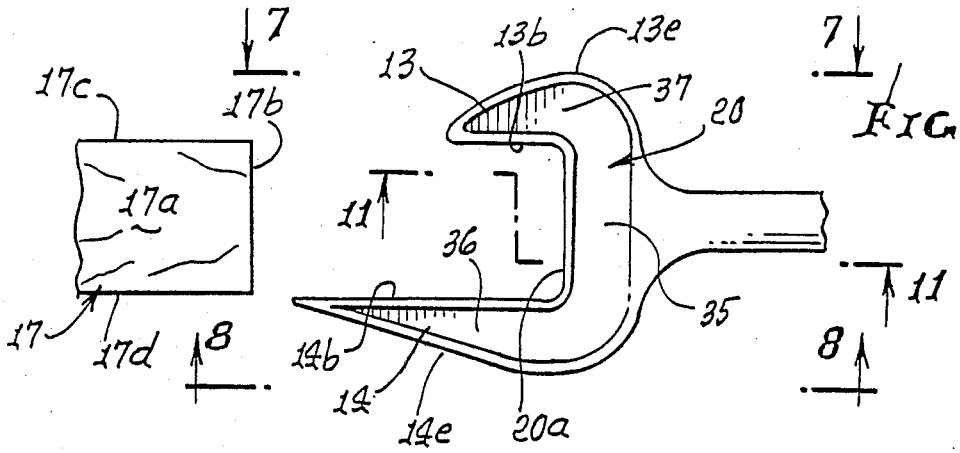
FIG. 6.
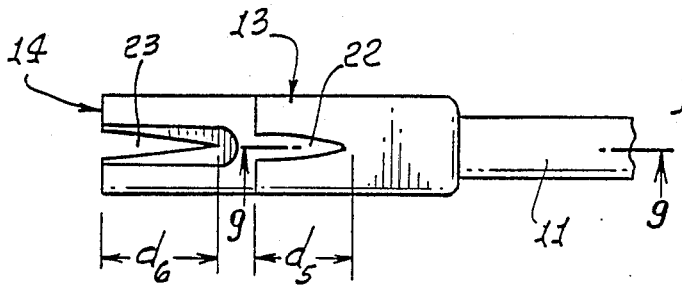
FIG. 7.
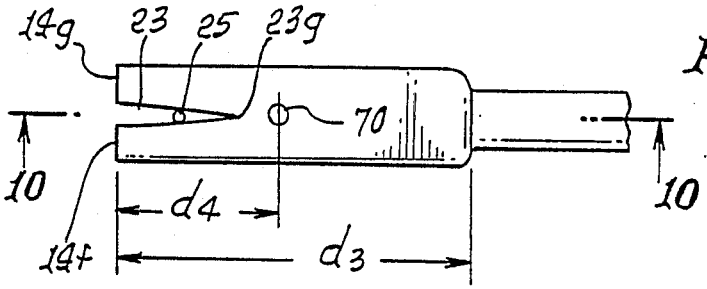
FIG. 8.
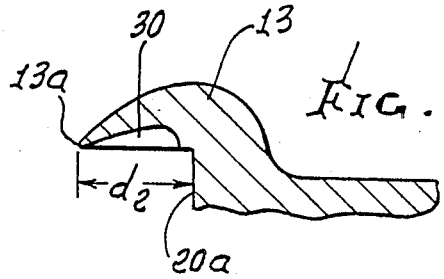
FIG. 9.
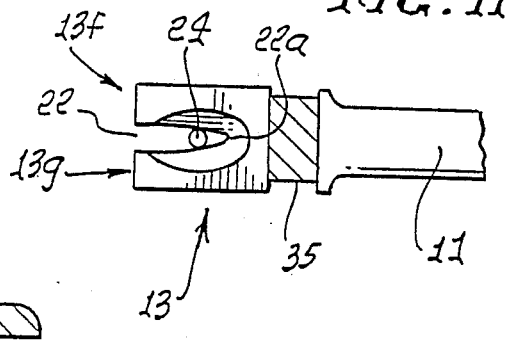
FIG. 11.
FIG. 10.
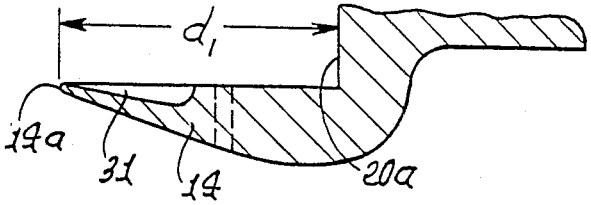

LUMBER TURNING TOOL WITH LEVERAGE ENHANCING CLAW SURFACES

BACKGROUND OF THE INVENTION

This application is a continuation-in-part of Ser. No. 002,748, filed Jan. 12, 1987, now Pat. No. 4,762,303.

This invention relates generally to tools of the type used for prying or loosening; and more particularly concerns a tool constructed especially to fit heavy duty lumber pieces, for prying them or forcibly twisting them, into desired positions, as for release from attachment to other members or for positioning them for nailing.

There is a need for tools of the character described above, since ordinary hammers lack the lumber prying or gripping capabilities required. For example, exertion of torque or twisting force on a wooden board of 2 inches by 4 or more inches cross section is frequently required during framing. Prior tools lacked the capability to easily handle such twisting and lacked other features of the tool described herein.

SUMMARY OF THE INVENTION

It is a major object of the invention to provide solutions to the above problems and difficulties, and also to provide a unique tool having multiple capabilities, for handling heavy duty wooden lumber members. Basically, the tool comprises:

(a) an elongated handle, and (b) a head having two opposed and spaced apart claws projecting in generally the same direction at opposite sides of a space to closely receive a portion of a rectangular cross section of a lumber member, (c) one of the claws at one side of said space being substantially shorter in length than the other of the claws at the opposite side of said space, each of said claws being bifurcated to define tines, at opposite sides of a slot, (d) said integral head including a transverse section interconnecting the claws, said claws having first inner surfaces defining faces that are parallel throughout their lengths at opposite sides of said space, said space having an innermost side, said transverse section having a transverse face at said innermost side of said space, said transverse face always extending in a plane that is normal to planes defined by said parallel faces, (e) said one claw having an outwardly convex outer surface to engage a work surface, and a second inner surface offset relative to said first inner surface thereof and toward said convex outer surface, said tines of the one claw having opposed faces that merge together at a locus that intersects said second inner surface.

As will appear, the head is typically C-shaped; a lumber member is receivable in the space between the claws to engage the transverse face of the transverse section; and said transverse face extends in a plane that is normal to planes defined by said parallel inner faces of the claws. The claws have outer surfaces and the inner and outer surfaces of each claw taper toward a tip; and the tips are located at substantially different distances from the transverse inner face of the head.

Further each claw is typically bifurcated to define tines having edges for nail gripping; and the tine edges of one claw are typically straight, whereas the tine edges of the other claw are typically concave, whereby nails of a wide range of cross-section sizes may be gripped and pulled. Further, the tines taper toward tips, facilitating penetration of the claws beneath members to be pried loose from connection to other members. Also, the second and offset inner surface of the one claw provides for greater leverage exertion on a nail head engaging that surface.

These and other objects and advantages of the invention, as well as the details of an illustrative embodiment, will be more fully understood from the following specification and drawings, in which:

DRAWING DESCRIPTION

FIG. 6 is a fragmentary side view of the head of the FIG. 1 tool;

FIG. 7 is a top plan view taken on lines 7—7 of FIG. 6;

FIG. 8 is a bottom plan view taken on lines 8—8 of FIG. 6;

FIG. 9 is a section taken on lines 9—9 of FIG. 7;

FIG. 10 is a section taken on lines 10—10 of FIG. 9;

FIG. 11 is a section taken on lines 11—11 of FIG. 6;

Figure 12:
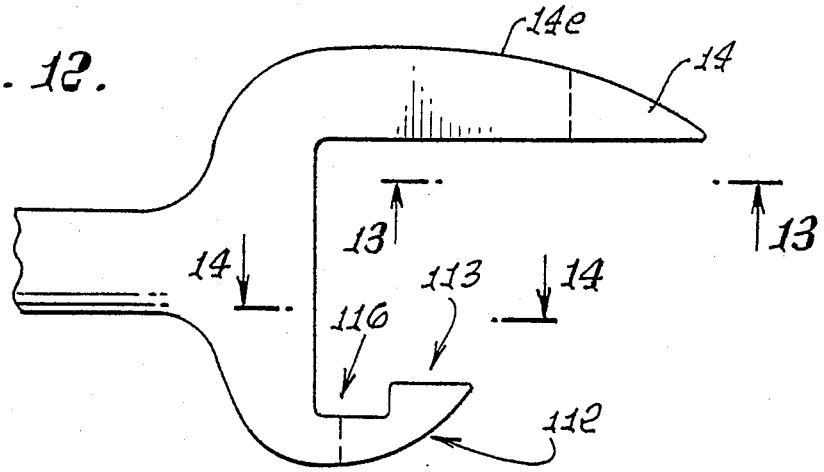
FIG. 12 is a side elevation showing a modified tool.
Figure 13:
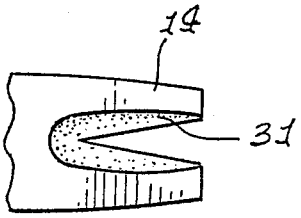
Figure 14:
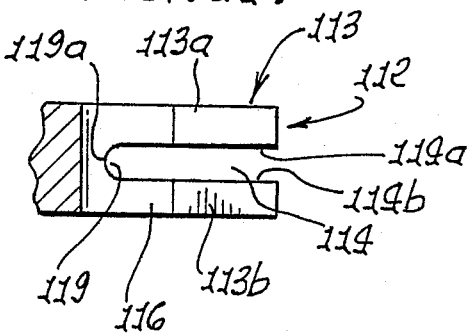
Figure 15:
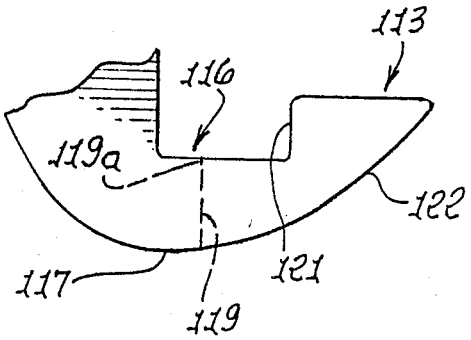

FIGS. 13 and 14 are views taken on lines 13—13 and 14—14 of FIG. 12, respectively;

FIG. 15 is a side view on lines 15—15 of FIG. 14; and

Figure 16:
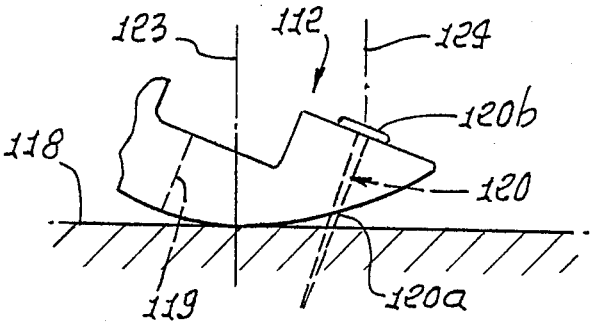
Figure 17:
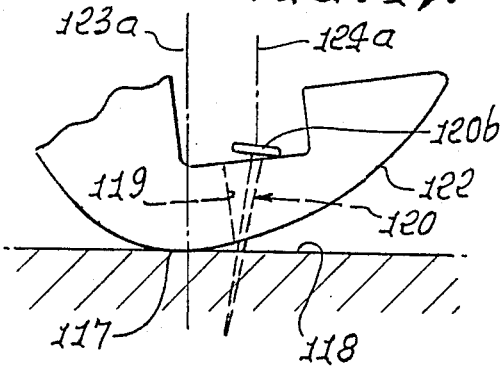

FIGS. 16 and 17 are views like FIG. 15, but showing stages in leverage exertion during nail pulling.

DETAILED DESCRIPTION

In FIGS. 1 and 6–11, the lever type tool 10 comprises an elongated handle 11, and a head 12 integral with the handle at one end thereof. Both the head and handle may consist of steel, the head being hardened. It has two spaced apart claws 13 and 14 projecting in generally the same direction, see arrow 15, and at opposite sides of a space 16, to closely receive a portion 17*a* of a rectangular cross section 17 of a lumber member, as for example a wooden two inch by four inch section as is commonly used in construction framing. One of the claws, i.e. claw 13, as shown, is substantially shorter in length than the other, claw 14 as shown, for several reasons as will appear. One reason is to facilitate grasping of the member 17, as shown in FIG. 2, with full reception of the lumber portion 17*a* into space 16.

Head 12 is C-shaped, and the claws taper toward their tips at 13*a* and 14*a*. This facilitates loosening, as by prying, of a member 17 nailed at 18 to another member or wall 19. Elongated claw 14 progressively penetrates behind the member 17, i.e. between member 17 and wall 19 during such prying, and during progressive grasping of the portion 17*a* by the claws.

Figure 2:
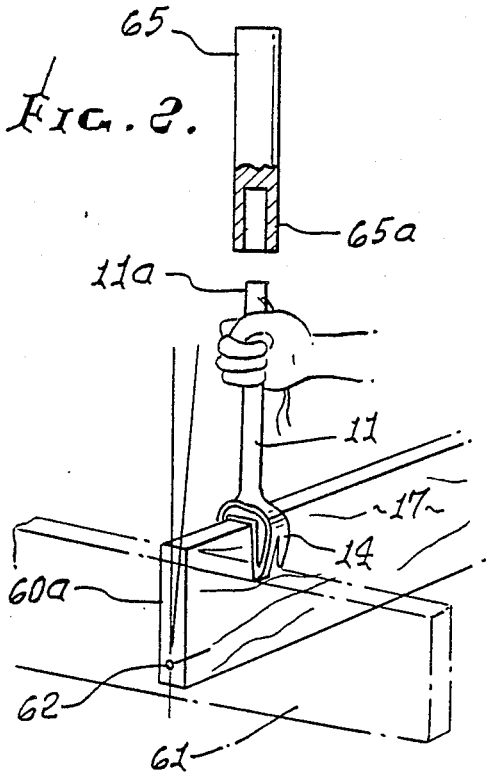
FIGS. 2–5 are perspective showing various uses of the FIG. 1 tool.
Figure 3:
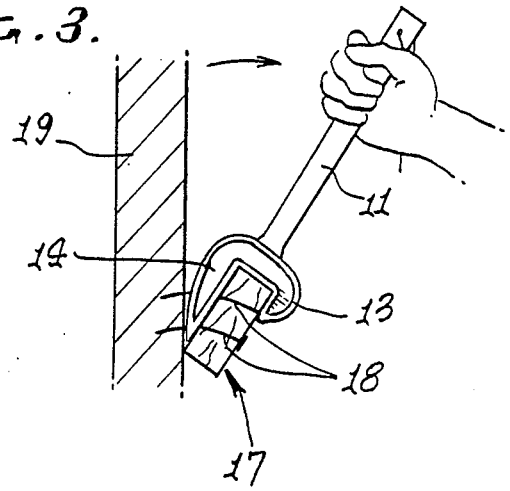

The head also includes a transverse section 20 interconnecting the claws, section 2- having a transverse face 20*a* at the innermost side of space 16. Face 2*a* extends in a plane that is normal to planes defined by parallel faces 13*b* and 14*b* of the claws, at opposite sides of space 16. Face 20*a* squarely and closely faces (and may engage) the end 17*b* of a wooden member 17 when faces 13*b* and 14*b* engage opposite sides 17*c* and 17*d* of that member, as is clear from FIGS. 2 and 6. For best results, the length $d_l$ between face 20*a* and tip 14*a* is approximately 2.5. times the length $d_2$ between face 20*a* and tip 13*a*. Typically, $d_l$ is about 7.5 centimeters, and $d_2$ is about 3 centimeters in length. Note that the outer surfaces 13e and 14e of the claws are outwardly convex, along these lengths between the transverse member 20 (with which such outer surfaces merge) and the tips 13a and 14a, for maximum claw strength, and also to permit rocking against the surface of a member as at 19 in FIG. 3.

Figure 5:
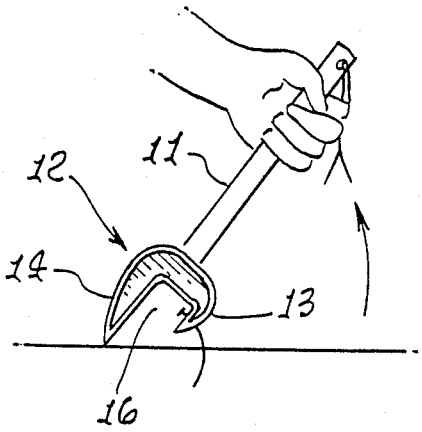
Figure 4:
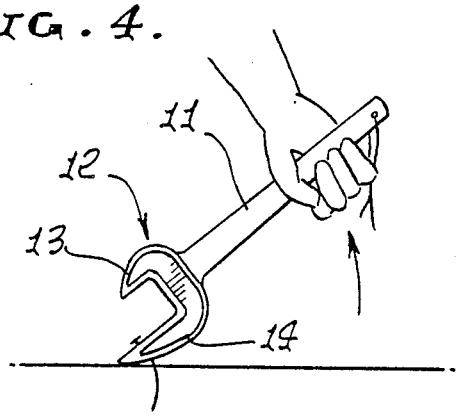

For nail pulling purposes, each rod claw is typically bifurcated, so as to form tines 13f and 13g associated with claw 13, and tines 14f and 14g associated with claw 14. The split 22 between tines 13f and 13g tapers toward an inner terminus 22a; and the split 23 between tines 14f and 14g tapers toward an inner terminus 23a. See FIGS. 7–11 in these regards. Note that the jaw edges 22b and 22c defined by split 22 may be concavely curved (as viewed in FIGS. 7 and 11) toward terminus 22a, whereby a nail 24 of relatively larger cross section may be grasped by such edges for ease of nail pulling (see FIG. 5); whereas the jaw edges 23b and 23c defined by split 23 (see FIG. 8) are linear, whereby a nail 25 of relatively lesser cross section may be grasped by such edges for ease of nail pulling (see FIG. 4). Note the large amount of leverage permitted, as in FIG. 5.

Also, the inner sides of the tines of each claw are recessed, to define bowl shaped depressions as at 30 and 31. Such recesses are adapted to receive nail heads during nail pulling, whereby the extent of the tine penetration required under or behind a nail head is minimized.

Finally, the opposite sides of the head 12 may be recessed as at 35–37, to reduce head weight.

FIG. 2 illustrates an important use of the tool 10. It is shown gripping an elongated wooden member 17 of rectangular cross section, for twisting its end 60a into position for nailing connection to a transverse wooden 61. One nail 62 extending through member 61 and into end 60a acts as a pivot, and the tool forcibly rotates the end 60a into position to receive a second nail through member 61 into end 60a securing it in position. The opposite remote end of member 17 is rigidly secured to other structure. Increased torque can be applied by connection of a bar 65 to the handle, as seen in FIG. 2. Bar 65 has a tubular end 65a adapted to closely fit over the end 11a of the tool handle, as shown. Note opening 70, for a tool hanging peg.

Figure 1:
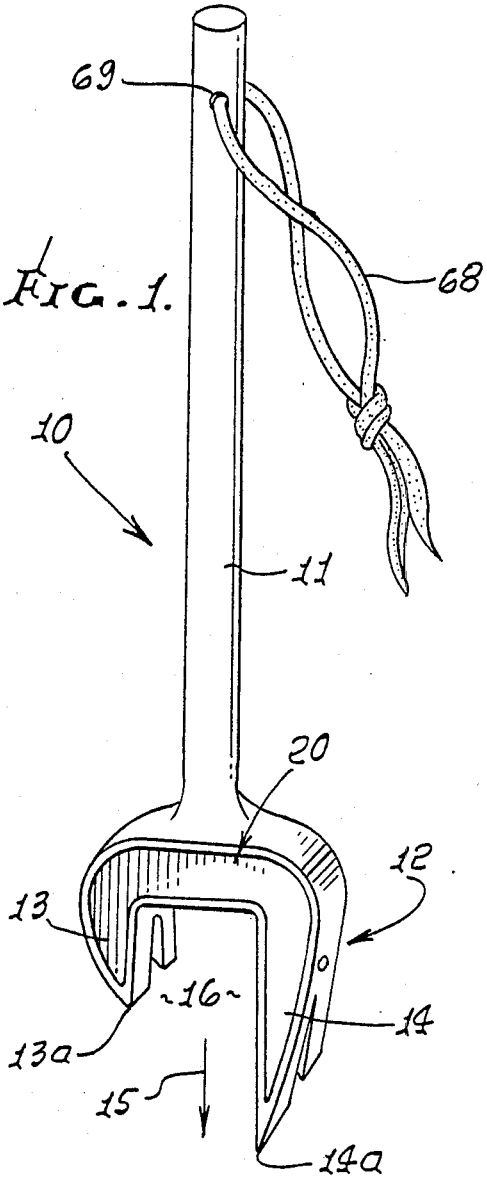
FIG. 1 is an elevation in perspective showing a tool embodying the invention.

FIG. 1 also shows a thong 68 attached at 69 to the handle, for ease of supporting the tool when not in use.

For best results, tool dimensions are as follows:

$d_1$=7.5 cm.

$d_2$=3 cm.

$d_3$=9.4 cm.

$d_4$=4.3 cm.

$d_5$-2.5. cm.

$d_6$=3 cm.

In FIGS. 12–15, the construction of the tool is the same as in FIGS. 1–10, with the following exceptions. The one claw 112 (corresponding to claw 12) has a first inner surface 113 bifurcated by split or slot 114 to define inner surface portions 113a and 113b which are substantially rectangular, as seen in FIG. 14. Opposite sides 114a and 114b of the slot are parallel. That claw also has a second inner surface 116 that is offset relative to surface 113, and outwardly toward the outwardly convex outer surface 117 of that claw. Surface 117 engages the work surface 118 during pulling of a nail, as seen in FIGS. 16 and 17.

The opposed parallel sides 114a and 114b of the slot merge together at a locus 119 that intersects the second inner surface at 119a. That locus positions the shank 120a of a nail 120 received in a position wherein the nail head 120b engages the second surface, as in FIG. 17. In effect, the nail head is then located against offset surface 116 to provide substantially enhanced leverage exertion upon a nail, with curved outer surface 117 engaging the work. Note step shoulder 121 between surfaces 113 and 116. Curvature of surface 117 opposite to or outwardly of flat surface 116 is much greater than the curvature of surface 22, along the length of claw 14.

In FIG. 16, claw surface 113 initially lifts the nail head as shown, with leverage exerted between plane 123 intersecting the work at the point surface 117 engages it, and plane 124 passing through the nail head. After the nail is lifted somewhat, the claw is pushed further under the nail head, to the position of FIG. 17, wherein the head now engages offset surface 116 as the claw is rocked. This enables greater leverage exertion between planes 123a and 124a corresponding to planes 123 and 124, but closer together.

Surfaces 113 and 116 are parallel. Slot 114 intersects surface 113 along its entire length, but intersects only part of the length of surface 116.

I claim:

1. In a lever type tool, the combination comprising:

(a) an elongated handle, and (b) a one-piece integral head having two opposed and spaced apart claws projecting in generally the same direction at opposite sides of a space to closely receive a portion of a rectangular cross section of a lumber member, (c) one of the claws at one side of said space being substantially shorter in length than the other of the claws at the opposite side of said space, each of said claws being bifurcated to define tines at opposite sides of a slot, (d) said integral head including a transverse section interconnecting the claws, said claws having first inner surfaces defining faces that are parallel through their lengths at opposite sides of said space, said space having a an innermost side, said transverse section having transverse face at said innermost side of said space, said transverse face always extending in a plane that is normal to planes defined by said parallel faces, (e) said one claw having an outwardly convex outer surface to engage a work surface, and a second inner surface offset relative to said first inner surface thereof and toward said convex outer surface, said tines of the one claw having opposed faces that merge together at a locus that intersects said second inner surface.

2. The combination of claim 1 wherein said head is generally C-shaped.

3. The combination of claim 1 including said portion of said section of the lumber member received in said space, said portion defining two parallel opposite faces extending adjacent said opposed first inner faces of the respective claws, the short claw having length less than half the width of said lumber member, and the other claw having length greater than half the width of the lumber member.

4. The combination of claim 1 wherein said one claw second inner surface is substantially parallel to said one claw first inner surface.

5. The combination of claim 1 wherein the slot defined between the tines of said one claw intersects said first inner surface of said one claw along the entire length of said first inner surface.

6. The combination of claim 5 wherein the tines of said other claw defines concave edges, and the tines of said one claw define linear edges.

7. The combination of claim 1 wherein each claw tapers toward a tip remote from the handle.

8. The combination of claim 1 wherein said one claw defines a step shoulder between said first and second inner surfaces of the one claw.

9. The combination of claim 1 wherein said transverse face at the innermost side of said space intersects said second inner surface of the one claw.

10. The combination of claim 1 wherein said claws have outer surfaces, said inner and outer surfaces of each claw taper toward a tip.

11. The combination of claim 7 wherein the said tips are at distances $d_1$ and $d_2$ from said transverse face, $d_1$ being approximately 2.5 $d_2$.

12. The combination of claim 11 wherein $d_1$ is about 7.5 centimeters and $d_2$ is about 3 centimeters.

13. The combination of claim 10 wherein said claw outer surfaces are outwardly convex along their lengths between said transverse member and said tips, the convex outer surface of said one claw having greater curvature opposite said second inner surface than opposite said first inner surface of the one claw.

14. In a lever type tool, the combination comprising:

(a) an elongated handle, and (b) a one-piece integral head on the handle, the head including two spaced apart claws each claw being bifurcated to define tines, the claws defining means for receiving and grasping a portion of a rectangular cross section of a lumber member, and for rotating the lumber member, and for simultaneously engaging opposite parallel faces of said lumber member, each claw capable of receiving a nail shank between the tines thereof, (c) one claw being shorter than the other claw, the claws defining means for engaging and pulling a nail grasped by the one claw while the other claw serves as a pivot during said pulling and while leverage is manually exerted on the handle, (d) the one claw having first inner surface means for engaging and pulling up on the underside of a nail head as the one claw is initially pried in a rotary direction by the handle, and said one claw has second inner surface means offset stepwise from said first inner surface means for engaging and pulling up on said under surface of the said head as the claw is subsequently pried in said rotary direction by the handle, the tines defined by the one claw defining a slot therebetween, the slot intersecting both said first and second inner surface means.

* * * * *